United States Patent [19]

De Vries et al.

[11] 4,390,808

[45] Jun. 28, 1983

[54] PICTURE DISPLAY DEVICE HAVING A GAS DISCHARGE DISPLAY PANEL

[75] Inventors: Gerhard H. F. De Vries; Harmanus B. Bulle, both of Eindhoven, Netherlands

[73] Assignee: U.S. Philips Corporation, New York, N.Y.

[21] Appl. No.: 194,160

[22] Filed: Oct. 6, 1980

[30] Foreign Application Priority Data

Oct. 10, 1979 [NL] Netherlands ..... 7907490

[51] Int. Cl.[3] ..... H01J 17/49

[52] U.S. Cl. ..... 313/584; 315/169.4

[58] Field of Search ..... 313/217, 188

[56] References Cited

U.S. PATENT DOCUMENTS 3,952,230 4/1976 Sakai ..... 313/217 X 3,991,341 11/1976 Ngo ..... 313/217 X

*Primary Examiner*—Palmer C. Demeo

*Attorney, Agent, or Firm*—Paul R. Miller

[57] ABSTRACT

A display device having a gas discharge display panel which comprises a plurality of sets of discharge cells (C). Each set (G) comprises N discharge cells (C) arranged according to a matrix of n rows and N/n columns where n≧2. Each set (G) furthermore comprises first and second electrode means for selectively energizing the N discharge cells (C). The first electrode means comprises N column conductors (A) with n column conductors (A) for each column of discharge cells (C). The column conductors (A) each have a discrete discharge surface element (a) such that in each column of cells (C) each cell (c) has associated therewith for selectively energizing the cell (c) a respective one of the discrete surface elements (a) and a surface element (O) of the second electrode means. Per set (G) the surface elements (O) of the second electrode means are electrically interconnected. The sets (G) are driven successively and in a driven set (G) all discharge cells (C) in accordance with the display information for that set. By simultaneously energizing all discharge cells (C) is a set (G) the duration of operation per cell is increased and an increased brightness is obtained.

9 Claims, 6 Drawing Figures

PICTURE DISPLAY DEVICE HAVING A GAS DISCHARGE DISPLAY PANEL

The invention relates to a display device including a gas discharge display panel and means for driving the panel wherein the gas discharge display panel is provided with a gas-tight envelope and within the envelope comprises a set of N discharge cells arranged in a matrix of n rows and N/n columns, where $n \geqq 2$, which set comprises first and second electrode means for selectively energising the N discharge cells, wherein the first electrode means comprises N column conductors extending transversely to the rows, with n column conductors for each column of discharge cells which n column conductors each have a discrete discharge surface element such that in each column of cells each cell has associated therewith for selectively energising the cell a respective one of the discrete discharge surface elements and a surface element of the second electrode means.

Such a display device is disclosed in U.S. Pat. No. 3,952,230 for displaying television pictures. As stated in this patent an increase in the number of rows of the gas discharge cells in the display panel results in a decrease in the brightness. This result follows indirectly from the formula $Th=Tf/m$, wherein Th is the line time for energising one row of gas discharge cells, Tf is the frame time for displaying one complete picture and m is the number of lines, that is to say the number of rows of gas discharge cells. Assuming that to obtain a flicker-free picture, at least 50 frames per second ($Tf=20$ msec) are necessary, and for an acceptable brightness, an operating time of approximately 100 $\mu$s per row of discharge cells ($Th=100$ $\mu$s) is necessary, this means that the number of rows m can at most be approximately 200. This number is too small not only for television display but also for alphanumerical display.

In order to solve the problem occurring in large display panels, U.S. Pat. No. 3,952,230 suggests an increase in the operating time of each discharge cell to p times the line time Th. In order to realize this, in a panel in which the factor $p=3$, each cathode is energised for a period of 3Th within the frame time Tf. The energisation of a cathode always takes place one line time later than the energisation of an immediately preceding cathode. Each column of discharge cells includes 3 anode conductors each insulated for the greater part and from these 3 conductors the insulation at subsequent cells of the column has been removed in a cyclic order. The anode conductors are energised in synchronisation with the scanning of the cathodes and to each anode conductor the information signal to be displayed is also applied for a period of 3Th. The manner in which the display panel is operated so as to obtain a higher brightness, however, is rather complicated.

An object of the present invention is to provide a display device, having a gas discharge display panel in which higher brightness may be obtained and in which structural simplifications may be carried out.

According to the invention, a display device as set forth in the opening paragraph is characterized in that the surface elements of the second electrode means of the set are electrically interconnected.

A first advantage of this display device is that all discharge cells of a set can be energised simultaneously, so that a considerable increase in the operating time per row of discharge cells and hence increased brightness is obtained. If, in a set comprising n rows of discharge cells, the rows were energised row by row, the available operating time per row would be Tv/n, where Tv is the frame time for one set. However by simultaneously energising the n rows, these rows operate during the complete frame time Tv, which for each row of cells means an increase in the operating time by a factor n.

A second advantage is that the possibility of simultaneously energising n ($n \geqq 2$) rows of discharge cells simplifies the control of the display panel with respect to the case in which the rows are supplied with successively phase shifted row scanning voltages.

A third advantage is that the construction of the display panel can be considerably simplified by the electrically conductive connection of the discrete surface elements of the second electrode means in a set of discharge cells.

The indications "row" and "column" given above and hereinafter should not be interpreted in a restricted sense as regards direction. A "row" may have any direction and the above description remains applicable if the words "row" and "column" are interchanged consistently.

The advantages of the invention are of particular value in a display device in which the gas discharge display panel comprises a plurality of sets of discharge cells and the N column conductors of a set are common to all the sets of which column conductors the pattern of discrete discharge surface elements is repeated for each set.

To operate a gas discharge display panel comprising p sets of discharge cells, where $p \geqq 1$, the display device may comprise means for successively driving the p sets, such that in a driven set all discharge cells are energised simultaneously in accordance with the display information for that set.

The electrical interconnection of the surface elements of the second electrode means of a set of discharge cells may be a feature of the means for driving the display panel or it may be a feature of the display panel itself. In the latter case according to the invention a gas discharge display panel comprising one or more sets of discharge cells is characterised in that the surface elements of the second electrode means of the or each set of discharge cells are electrically interconnected within the panel. According to a further embodiment the second electrode means in the or each set of discharge cells consists of a single or a respective single conductor.

Embodiments of the invention will now be described by way of example with reference to the accompanying drawings, in which.

Figure 1:
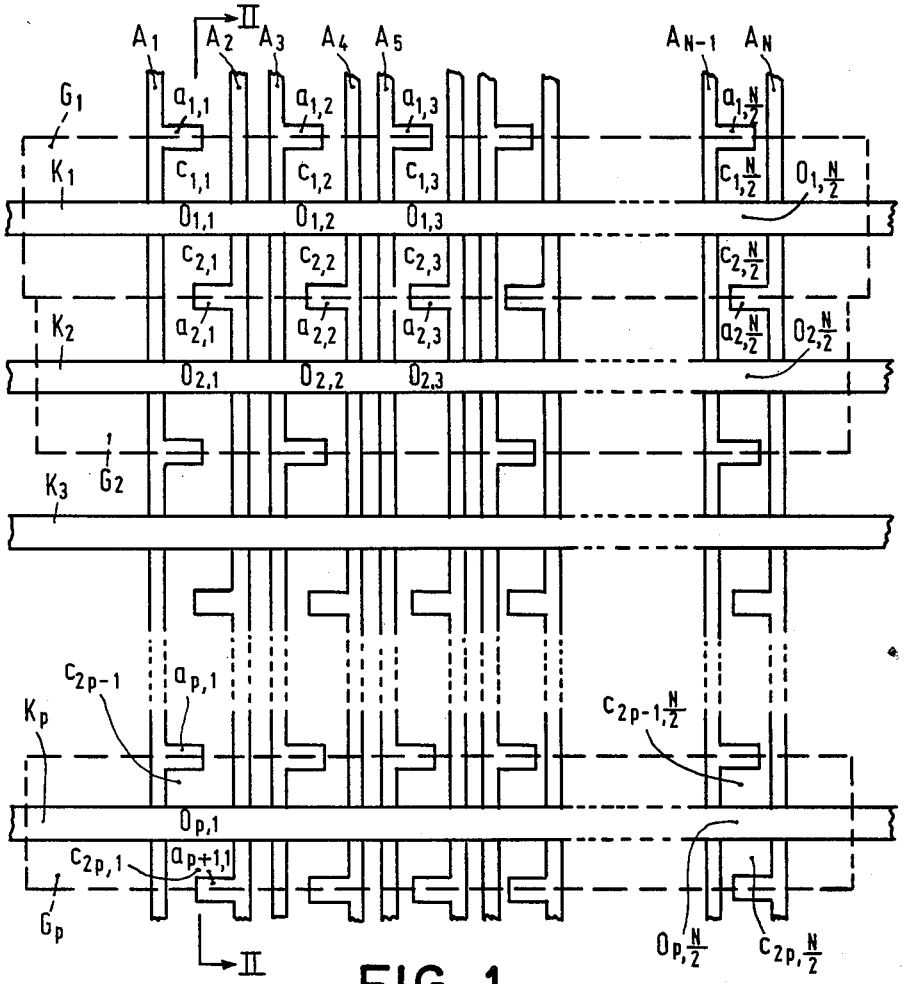
FIG. 1 is an elevation of a gas discharge display panel embodying the invention, with $n=2$.

The gas discharge panel shown in FIG. 1 comprises a plurality of sets $G_s$($s=1, 2, 3, \ldots p$), each comprising N discharge cells arranged in a matrix. Each set $G_s$ is bounded in the Figure by a rectangle in broken lines, and comprises $n=2$ rows of discharge cells, namely a first row of discharge cells $C_{2s-1,r}$($s=1, 2, 3, \ldots p$ respectively for the different sets; $r=1, 2, 3, \ldots N/2$ for each set) and a second row of discharge cells $C_{2s,r}$($s=1, 2, 3, \ldots p$ respectively for the different sets; $r=1, 2, 3, \ldots N/2$ for each set). There are N/n columns of cells. Each collection $G_s$ furthermore comprises a first and a second electrode means. The first electrode means consists of N column conductors $A_k$($k=1, 2, 3, \ldots N$), which are insulated for the greater part, extend transversely to the direction of the rows of discharge cells and have discrete discharge surface elements $a_{q,r}$($q=s, s+1$ for the respective pairs of rows of different sets; $r=1, 2, 3 \ldots N/2$ for each set) not provided with insulation; for each value of s from 2 to $(p-1)$ inclusive, each element $a_{q,r}$ is common to two adjacent sets. The second electrode means consists of conductors $K_s$($s=1, 2, 3, \ldots p$) extending in the direction of the rows with surface elements $O_{s,r}$($s=1, 2, 3, \ldots p$ respectively for the different sets; $r=1, 2, 3, \ldots N/2$ for each set). The surface elements $O_{s,r}$ constitute the cathode electrodes and the surface elements $a_{q,r}$ constitute the anode electrodes of the individual cells of the display panel. For each discharge cell, a respective surface element $a_{q,r}$ is associated with a surface element $O_{s,r}$ common to a pair of cells in the same set. Thus, in a set $G_s$ the surface elements $O_{s,r}$ are associated with the surface elements $a_{s,r}$ in the first row of discharge cells $C_{2s-1,r}$ and with the surface elements $a_{s+1,r}$ in the second row of discharge cells $C_{2s,r}$. A surface element $O_{s,r}$ (i.e. cathode electrode $O_{s,r}$) thus co-operates with two surface elements, $a_{s,r}$ and $a_{s+1,r}$ (i.e. anode electrodes $a_{s,r}$ and $a_{s+1,r}$), to form two discharge cells $C_{2s-1,r}$ and $C_{2s,r}$, respectively. In a set $G_s$, the cathode electrodes $O_{s,r}$($r=1, 2, 3, \ldots N/2$) are electrically connected together, by being part means of the conductor $K_s$. The conductors $K_s$ are successively energised with a voltage pulse of, for example, $-125$ Volts for a period of time Tf/p (where Tf is the frame time for one complete picture and p is the number of collections). Simultaneously and also for that period Tf/p, the column conductors $A_1, A_2, A_3, \ldots A_N$ are selectively energised with positive voltage pulses in accordance with the display information so that discharge cells in the set $G_s$ ignite in accordance with the display information. When, for example, the conductor $K_1$ in the set $G_1$ is energised for a period Tf/p with a voltage of $-125$ Volts and simultaneously the column conductors $A_1, A_2, A_3, \ldots A_N$ are selectively energised with voltage pulses (of, for example, $+150$ Volts) the picture information of which is such that, for example, only the conductors $A_1$, $A_3$ and $A_4$ obtain a positive voltage pulse, then only the discharge cells $C_{1,1}$; $C_{1,2}$ and $C_{2,2}$ of the set $G_1$ will ignite. After a period Tf/p, all discharge cells of $G_1$ that were ignited are extinguished, and conductor $K_2$ is energised with a negative voltage pulse of $-125$ Volts. Simultaneously, column conductor $A_1$ to $A_N$ are provided with new positive voltage pulses in accordance with the display information for the set $G_2$. After a period Tf/p, all discharge cells of $G_2$ that were ignited are extinguished and the discharge cells of a set $G_3$ are driven in an analogous manner. In this manner, in the frame time Tf, all sets $G_s$($s=1, 2, 3, \ldots p$) are energised successively, each for a period Tf/p. After the set $G_p$ has been energised, the set $G_1$ is again energised and the cycle described is repeated for all the sets with a frequency of 1/Tf complete displays per second. In the given example with $n=2$, two rows of discharge cells are simultaneously energised so that each row operates for twice as long as in the case in which the rows of discharge cells are energised row by row.

Figure 2:
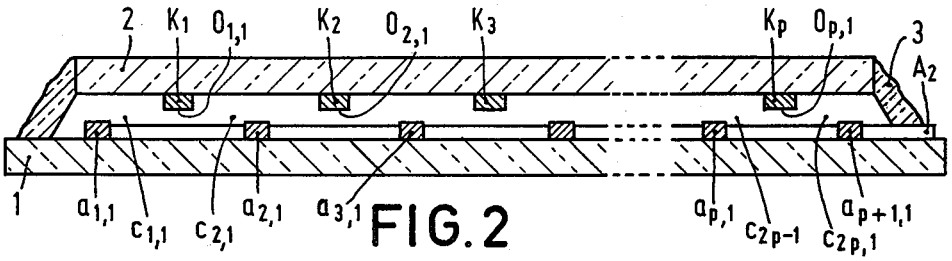
FIG. 2 is a cross-sectional view, taken on the line II—II, of the panel shown in FIG. 1.

FIG. 2 shows the construction of the display panel in a cross-sectional view taken on the line II—II in FIG. 1. The column conductors $A_1, A_2, \ldots A_N$ are mounted on a glass face plate 1 and the row conductors $K_1, K_2, \ldots K_p$ are mounted on a glass rear plate 2. The plates 1 and 2 are kept at a defined distance from each other by spacing members (not shown) and are connected together in a gas-tight manner along the circumference by means of a sealing glass 3. The space between the plates 1 and 2 is filled with a suitable ionisable gas, for example, neon or a Penning mixture of neon-argon.

Figure 3:
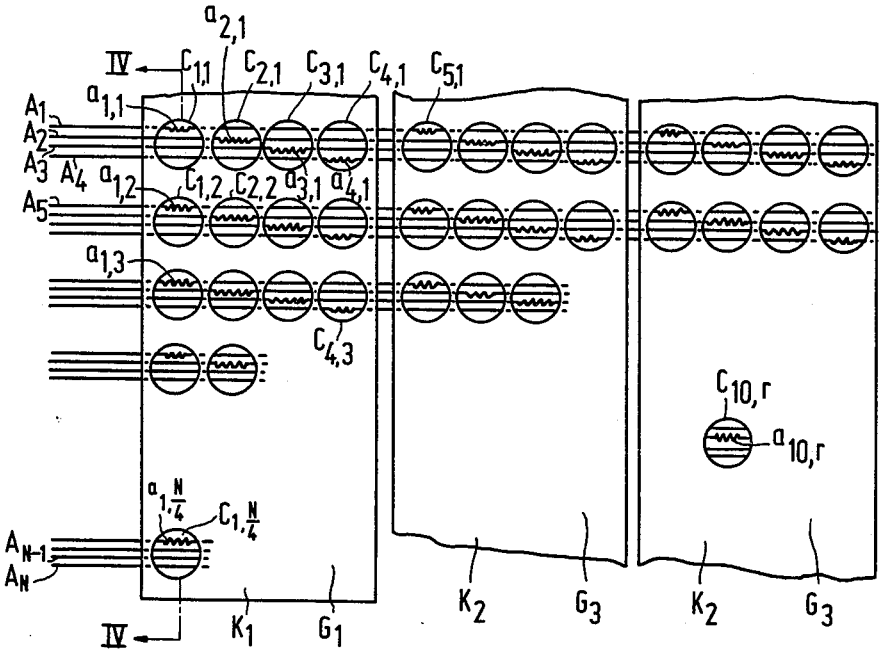
FIG. 3 is an elevation of another embodiment of the invention with STET $n=4$.
Figure 4:
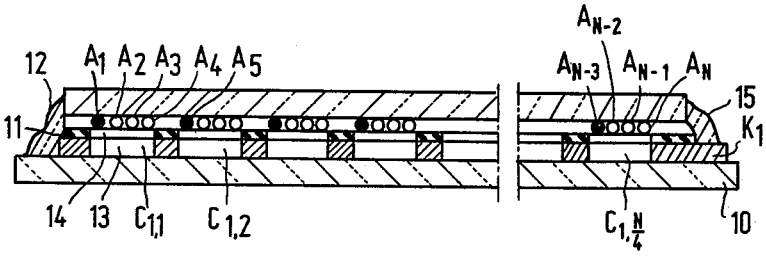
FIG. 4 is a cross-sectional view, taken on the line IV—IV, of the panel shown in FIG. 3, and FIGS. 5*a* and 5*b* illustrate a method of operating the gas discharge display panel shown in FIG. 3.

FIG. 3 shows another embodiment of the invention in which each set $G_s$($s=1, 2, 3$) comprises four (i.e. $n=4$), rows of discharge cells C (which in the drawing are vertical). For clarity, corresponding elements are referred to by the same reference numerals as in FIG. 1. Each of the sets $G_s$ again comprises N discharge cells arranged in a matrix with n rows and N/n columns, namely a first row of discharge cells $C_{4s-3,r}$, a second row of discharge cells $C_{4s-2,r}$, a third row of discharge cells $C_{4s-1,r}$ and a fourth row of discharge cells $C_{4s,r}$, where $s=1, 2, 3$ respectively for the different sets and $r=1, 2, 3, \ldots N/4$ for each row. Each set again comprises a first electrode means consisting of N column conductors $A_k$($k=1, 2, 3, \ldots N$), which are insulated for the greater part, extend transversely to the direction of the rows (in the drawing, horizontally) and are provided with discrete discharge surface elements $a_{q,r}$($q=4s-3, 4s-2, 4s-1, 4s$ for the respective four rows of different sets; $r-1, 2, 3, \ldots N/4$ for each row) which are not provided with insulation. In the drawing these surface elements are shown as zig-zag lines. In each collection $G_s$, each column of discharge cells includes four column conductors $A_k$ of which conductors $A_k$ always another one in a subsequent discharge cell of a column has a discrete discharge surface element $a_{q,r}$ which is not provided with insulation. The column conductors $A_k$ extend over the three sets $G_1$, $G_2$ and $G_3$ and the pattern of surface elements $a_{q,r}$ not provided with insulation is repeated in each set. The second electrode means consists in set $G_1$ of a conductor $K_1$, in set $G_2$ of a conductor $K_2$, and in set $G_3$ of a conductor $K_3$. As shown for the conductor $K_1$ in the sectional view of FIG. 4 taken on the line IV—IV of FIG. 3, each of the conductors $K_1$, $K_2$ and $K_3$ consists of a conductor which is mounted on a glass face plate 10 and in which apertures 13 are arranged in four rows for each discharge cell C. The column conductors $A_k$ are mounted on a glass rear plate 12 and are kept at a defined distance from the conductors $K_1$, $K_2$ and $K_3$ by means of an insulating intermediate plate 11 having apertures 14 corresponding to the apertures 13. The plates 10 and 12 are secured together again in a gas-tight manner by means of sealing glass 13 at their circumference.

The display panel shown in FIG. 3 is driven in a manner analogous to that described with reference to FIG. 1. A possible manner of driving is shown in FIG. 5*b* for a panel shown diagrammatically in FIG. 5*a* with six sets, $G_1$ to $G_6$, of cells in the construction of FIG. 3. In order to avoid complexity of the drawing, only the column conductors $A_1$, $A_2$, $A_3$ and $A_4$ associated with the first column and the column conductors $A_{N-3}$, $A_{N-2}$, $A_{N-1}$, and $A_N$ associated with the last column are shown. The column conductors are connected to a column selection circuit 30 and the conductors $K_1$ to $K_6$ are connected to a row selection circuit 31. The panel furthermore comprises a conductor S which together with $A_1, A_5, A_9, \ldots A_{N-3}$ forms a row of starter cells $S_1, S_2, S_3 \ldots S_{N/4}$, respectively. The panel furthermore comprises a keep alive cell P which is energised continuously during operation. The conductor S is also connected to the row selection switch 31. FIG. 5*b* shows the energisation of the conductors A, S and K, in time. At the instant $t_o$ the conductor S is energised with a voltage pulse $Vs = -125$ Volts. Simultaneously the conductors $A_1, A_5, A_9, \ldots A_{N-3}$ are energised with a voltage $V1 = +150$ V, so that all starter cells $S_1$ to $S_{N/4}$ ignite and the voltage at the conductors $A_1, A_5, A_9 \ldots A_{N-3}$ drops to the operating voltage $V_2 = +125$ Volts. Metastable and ionised particles flow from the keep alive cell P to the starter cell $S_1$ and then to the starter cell $S_2$, and so on, so that these cells ignite rapidly when energised. Metastable and ionised particles similarly flow from the starter cells to the discharge cells of the first set $G_1$. At the instant $t_1$ the conductor $K_1$ is energised with a voltage pulse $V_3' = -125$ V. All conductors $A_1$ to $A_N$ are energised for a short period of time with a voltage pulse $V_1' = +125$ V so that all discharge cells in the set $G_1$ operate for a short period of time and metastable and ionised particles are formed in the cells. The voltages at the conductors $A_1$ to $A_N$ are then selectively maintained at the operating voltage $V_2' = +125$ V in accordance with the display information. In the given example the voltage $V_2'$ is maintained at the conductors $A_1, A_3, A_6$ and $A_N$ so that the discharge cells $C_{1,1}, C_{3,1}, C_{2,2}$ and $C_{4,N/4}$ operate. This condition is maintained up to the instant $t_2$, such that the time interval $t_2 - t_1$ is about equal to $Tf/p(p=6)$. When the frame frequency is 50 frames per second, $Tf = t_{13} - t_0 = 20$ msec. This means that the cells in set $G_1$ operate for about $20/6 = 3.3$ msec. By energising the conductor $K_2$ with a voltage pulse $V_3'' = -125$ V and energising all conductors $A_1$ to $A_N$ with voltage pulses $V_1'' = +150$ V at the instant $t_3$, all cells of the set $G_2$ are ignited for a short period of time, metastable and ionised particles being formed in the cells. Operating voltages $V_2'' = +125$ V are then selectively maintained at the conductors $A_1$ to $A_N$ in accordance with the display information. In the given example the voltage $V_2''$ at the conductors $A_4$ and $A_5$ are maintained so that the discharge cells $C_{8,1}$ and $C_{5,2}$ operate. This condition is maintained up to the instant $t_4$ such that $t_4 - t_3$ is about equal to $Tf/p(p=6)$. In an analogous manner the cells of the sets $G_3, G_4, G_5$ and $G_6$ are driven successively. In set $G_3$ the cells $C_{10,1}$ operate, in $G_4$ the cells $C_{13,1}$ and $C_{16,1}$ operate, in $G_5$ the cells $C_{16,1}$ and $C_{19,1}$ operate and in $G_6$ the cell $C_{21,2}$ operates. At the instant $t_{13}$ all starter cells $S_1$ to $S_{N/4}$ are ignited again and the cycle described for the sets $G_1$ to $G_6$ is repeated, voltage pulses corresponding to possibly changed display information being supplied to the conductors $A_1$ to $A_N$. In FIG. 5*b* the time intervals $t_3 - t_2$; $t_5 - t_4$; $t_7 - t_6$; $t_9 - t_8$; $t_{11} - t_{10}$ and $t_{13} - t_{12}$ are shown as finite intervals between the energisation of cells of one set and cells of a succeeding set. In practice, however these intervalls are very small or equal to zero. The time interval $t_1 - t_0$ is also very small (about 10 microseconds). Consequently within the period $t_{13} - t_0$ the cells of each set are energised for a period of about Tf/p.

Figure 5A:
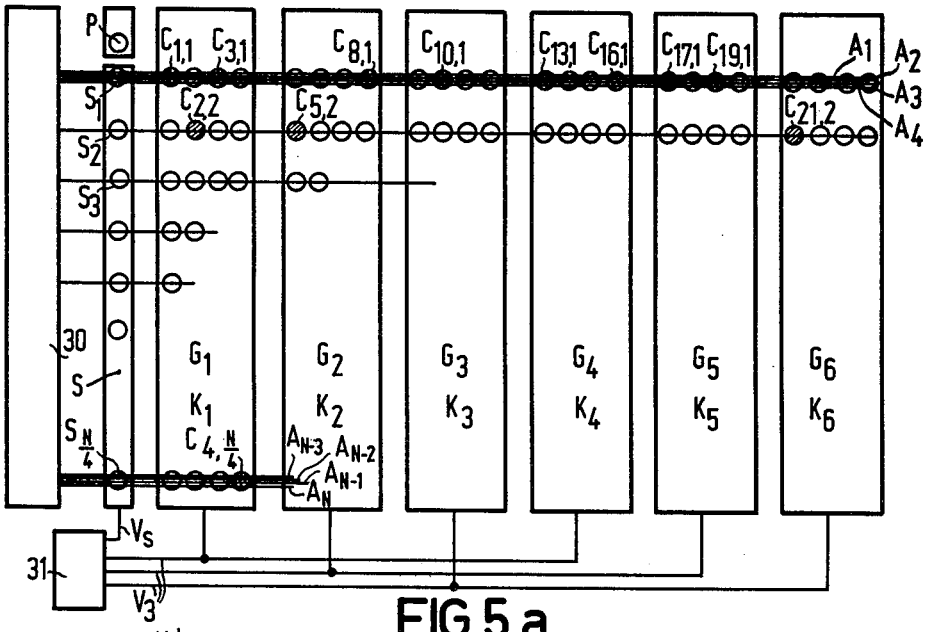
Figure 5B:
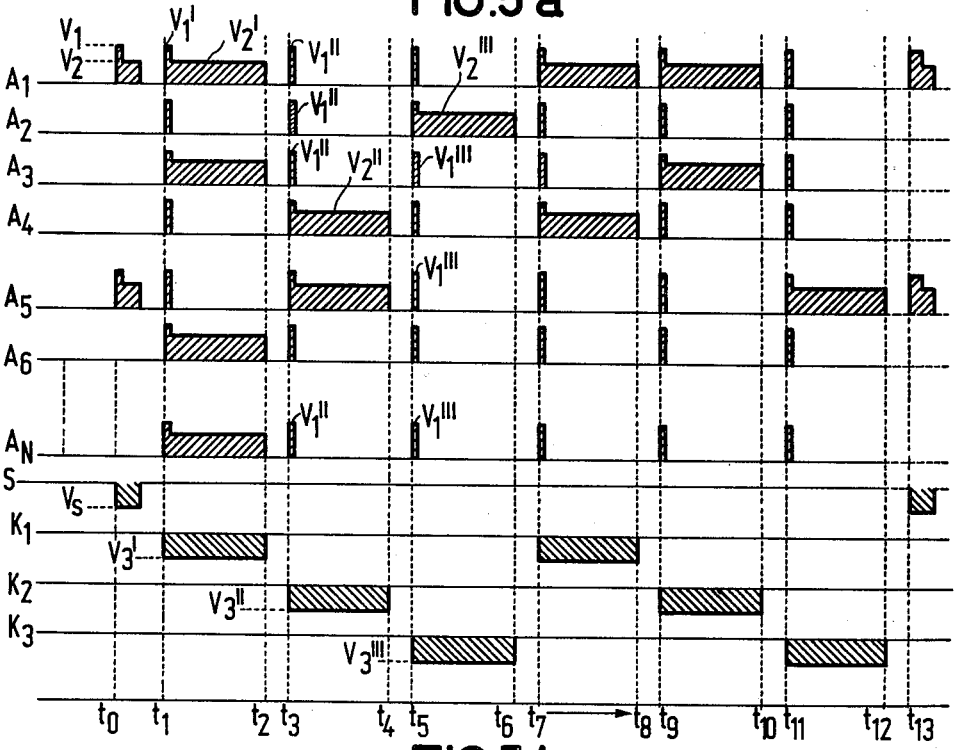

As shown in FIG. 5*a*, the conductors $K_1$ to $K_6$ are divided into three groups, $K_1$ being connected to $K_4$, $K_2$ being connected to $K_5$, and $K_3$ being connected to $K_6$. As a result, so-called 3-phase scanning will be obtained. When $K_1$ is energised, $K_4$ will also be energised. However, only discharge cells of the set $G_1$, and not those of $G_4$, will ignite for the following reason. When the starter cells $S_1$ to $S_{N/4}$ operate, metastable and ionised particles flow (as already stated) to the nearest cells of the set $G_1$ so that these cells are brought into a condition in which they can easily ignite. The condition for igniting the cells in $G_1$ are thus more favourable than those for the cells in $G_4$. All cells in $G_1$ are ignited for a short period of time. The metastable and ionised particles formed flow to the cells in $G_2$. Therefore, for the same reason, the cells in $G_2$ and not those in $G_5$ will ignite when the conductor $K_2$ is energised. Metastable and energised particles similarly flow from the cells in $G_2$ to the cells in $G_3$. When $K_3$ is energised therefore the cells in $G_3$ and not those in $G_6$ will ignite. Metastable and ionised particles similarly flow from the ignited cells in $G_3$ to the cells of $G_4$. Therefore, when $K_4$ is energised, and hence also $K_1$, only the cells of $G_4$ and not those of $G_1$ will ignite, because $G_4$ is closer to $G_3$ than $G_1$. After the cells in $G_5$ and $G_6$ have thus been successively ignited and extinguished, the starter cells S to $S_{N/4}$ will again be ignited and the ignition cycle starts again in the cells of $G_1$.

Instead of using a row of starter cells S, igniting all cells in a collection and then extinguishing those cells that are not required, and relying on the flow of metastable and ionised particles from ignited cells to the cells of the next set, it is alternatively possible for a good operation of the panel to use auxiliary discharge cells which are situated in line with the picture discharge cells and are operated by co-operation of the conductors $K_1$ to $K_6$ with an extra set of N column conductors which is arranged in the panel in the same manner as the column conductors $A_1$ to $A_N$, but which is situated on the other side of the plane of the conductor $K_1$ to $K_p$. In this manner sets of auxiliary discharge cells are also obtained which are ignited in sets and from which metastable and ionised particles can flow to the picture discharge cells of the corresponding sets $G_1$ to $G_p$.

In the display panels described with reference to FIGS. 1 and 3, the conductors $K_s$ may consist entirely of aluminium and the column conductors $A_1$ to $A_N$ may consist of aluminium conductors anodised at the surface and of which the oxide skin is locally removed to form the surface elements $a_{q,r}$.

What is claimed is:

1. A display device including a gas discharge display panel and means for driving the panel wherein the gas discharge display panel is provided with a gas-tight envelope and within said envelope comprises a set of N discharge cells arranged in a matrix of n rows and N/n columns, where $n \geqq 2$, which set comprises first and second electrode means for selectively energising the N discharge cells, wherein the first electrode means comprises N column conductors extending transversely to the rows, with n column conductors for each column of discharge cells which n column conductors each has a discrete discharge surface element such that in each column of cells each cell has associated therewith for selectively energising the cell a respective one of the discrete discharge surface elements and a surface element of the second electrode means, characterized in that the surface elements of the second electrode means of the set are electrically interconnected.

2. A display device as claimed in claim 1, characterized in that it comprises a plurality of said sets of discharge cells and the N column conductors of a set are common to all the sets of which column conductors the pattern of discrete discharge surface elements is repeated for each set.

3. A display device as claimed in claim 1 or 2, wherein the panel comprises p sets of discharge cells, where $p \geqq 1$, characterized in that the device comprises means for successively driving the p sets, such that in a driven set all discharge cells are energised simultaneously in accordance with the display information for that set.

4. A gas discharge display panel having a gas-tight envelope and within said envelope comprises a set of N discharge cells arranged in a matrix of n rows and N/n columns, where $n \geqq 2$, which set comprises first and second electrode means for selectively energising the N discharge cells, wherein the first electrode means comprises N column conductors extending transversely to the rows with n column conductors for each column of discharge cells, which n column conductors each have a discrete discharge surface element such that in each column of cells each cell has associated therewith for selectively energising the cell a respective one of the discrete discharge surface elements and a surface element of the second electrode means, characterized in that the surface elements of the second electrode means of the set are electrically interconnected within the panel.

5. A gas discharge display panel as claimed in claim 4, characterized in that it comprises a plurality of said sets of discharge cells and the N column conductors of a set are common to all the sets of which N column conductors the pattern of discrete discharge surface elements is repeated for each set.

6. A gas discharge display panel as claimed in claim 4 or 5, characterized in that the second electrode means in at least one set of discharge cells consists of a single conductor or a respective single conductor.

7. A gas discharge display panel as claimed in claim 6 when appendant to claim 5, characterized in that the conductors of the second electrode means of all sets are divided into groups with corresponding conductors of the groups being electrically interconnected.

8. A gas-discharge display panel as claimed in claim 6, wherein $n=2$, characterized in that the respective single conductor of each set extends in the direction of the rows and in that the two column conductors for each column of cells are situated on opposite sides of the column and for each set of cells have two projections extending parallel to the single conductor of the set, respectively on opposite sides thereof, said projections comprising the discrete surface elements of the first electrode means.

9. A gas discharge display panel as claimed in claim 6, characterized in that the single conductor or each respective single conductor comprises a respective aperture for each cell of the set.

* * * * *